US005855624A

United States Patent [19]

Fujitani et al.

[11] Patent Number: 5,855,624

[45] Date of Patent: Jan. 5, 1999

[54] FIBERS, A PROCESS FOR PREPARING THE SAME AND PRODUCT THEREOF

[75] Inventors: Kango Fujitani, Uji; Yoko Fukuyama, Ichikawa; Toshio Watanuki, Kitakatsuragi-gun; Hiroyuki Miura, Konan; Yutaka Tsujimoto, Akashi; Kazuhisa Honda, Matsubara; Yoshitaka Uno, Kusatsu; Yoshiaki Sakai, Kashihara, all of Japan

[73] Assignee: New Japan Chemical Co., Ltd., Kyoto, Japan

[21] Appl. No.: 817,162

[22] PCT Filed: Sep. 21, 1995

[86] PCT No.: PCT/JP95/01901

§ 371 Date: Apr. 16, 1997

§ 102(e) Date: Apr. 16, 1997

[87] PCT Pub. No.: WO97/67279

PCT Pub. Date: Feb. 27, 1997

[30] Foreign Application Priority Data

Aug. 18, 1995 [JP] Japan ..... 7-210606

[51] Int. Cl.[6] ..... D06M 13/224; D06M 15/507

[52] U.S. Cl. ..... 8/120; 8/115.6; 8/115.56; 8/130; 427/389.9; 427/392; 427/394; 427/396; 427/383.4; 442/93; 428/364; 428/365

[58] Field of Search ..... 8/120, 115.6, 115.56, 8/115.61, 130; 252/8.84, 8.86, 8.83; 427/389.9, 392, 394, 396, 393.4; 442/93; 428/364, 365

[56] References Cited

U.S. PATENT DOCUMENTS 3,694,257 9/1972 Dumont ..... 252/8.83

FOREIGN PATENT DOCUMENTS 679 303 A 9/1966 Belgium .
5-247844 9/1993 Japan .

*Primary Examiner*—Alan Diamond
*Attorney, Agent, or Firm*—Armstrong, Westerman, Hattori, McLeland & Naughton

[57] ABSTRACT

The present invention relates to cellulose fibers excellent in dirt removability and a method of treatment thereof. The cellulose fibers of the invention are liquid ammonia-treated cellulose fibers whose partial or entire exterior is coated with an ester of (A) a polycarboxylic acid having at least three carboxyl groups and (B) a hydrophilic polyol having an oxyethylene group or groups and at least two alcoholic hydroxyl groups and/or which fibers are impregnated with the ester.

13 Claims, No Drawings

FIBERS, A PROCESS FOR PREPARING THE SAME AND PRODUCT THEREOF

This application is a 371 of PCT/JP95/01901 filed Sep. 21, 1995.

FIELD OF THE INVENTION

The present invention relates to cellulose fibers excellent in the property of removing dirt, a process for preparing the same and a product thereof. The invention also concerns with a product of cellulose-free synthetic fibers and a process for preparing the product thereof.

BACKGROUND ART

Cellulose fibers, typically cotton, are widely used for clothes and products of fibers because of their many advantages such as high hygroscopicity and good feel. Products of cellulose fibers are soiled with oil, sebum, mud or the like due to the use and wearing and are cleaned by laundry for re-use. However, such dirt is likely to cling to cellulose fibers and products thereof and can not be easily removed by laundry. Consequently, this leads to disadvantages of stain, black smear, discolored smudge, etc. which reduce the value of clothes and the like. For this reason, a need exists for products of cellulose fibers having improved dirt-removing property (dirt removability). Dirt does not easily come off by laundry from cotton and the like which readily absorb oily and aqueous substances. So far, products of cotton free from said problem have not been found.

In such current situation, it has been proposed to attach polyvinyl alcohol as a laundry size to products of cellulose fibers. The proposed method contemplates causing the dirt to adhere to polyvinyl alcohol so that the dirt is separated, together with polyvinyl alcohol, from the product of cellulose fibers by laundry. However, the method can achieve this effect only once, and necessitates depositing polyvinyl alcohol on a product of cellulose fibers every time the product is washed. Thus the method can not be said to be means for improving dirt removability.

On the other hand, polyester, nylon and other synthetic fibers are extensively used for their numerous advantages such as high mechanical properties, chemical resistance and ease of care, but have a drawback of tending to permit accumulation of static electricity. Various antistatic agents have been used to overcome the drawback, but substantially all of them come off during laundry and are merely temporarily effective.

For practical use as clothes, products of synthetic fibers should be imparted laundry durability as well as antistatic property. As a method of giving antistatic property to a product of synthetic fibers, it is known to coat synthetic fibers with a hydrophilic polymer having double bonds by radical polymerization (Japanese Examined Patent Publication No.40,554/1985).

However, a fully crosslinked polymer needs to be formed to produce a coating film having the required washing resistance from a hydrophilic polymer. The radical polymerization of a hydrophilic polymer with double bonds for conversion to a crosslinked polymer entails a disadvantage of essentially using an ethyleneimine derivative, i.e. a highly toxic crosslinking agent or a volatile, highly toxic acrylic acid.

Said conventional procedure makes it difficult to maintain hygiene and healthy working environment, and needs special apparatus. Therefore the procedure has not been a useful technique in an ordinary processing plant which is intended to use mainly open-type equipment. Further a serious problem has been posed in that products of synthetic fibers should be subjected to a washing process of considerable scale to make the product of synthetic fibers non-skin irritable.

The accumulation of static electricity described above is due to the inherent hydrophobicity of synthetic fiber resins. The hydrophobicity of synthetic fiber resins raises another disadvantage that dirt is firmly held by products of synthetic fibers. In other words, dirt, for example, oily dirt such as oil grime and lipstick smudge is not easily removed from clothes of synthetic fibers and will not easily come off by washing. Unavoidably the dirt remains on products of synthetic fibers. However, no technique has been developed to improve the dirt removability of synthetic fiber products and to prevent dirt from permanently sticking to synthetic fiber products.

DISCLOSURE OF THE INVENTION

A first object of the present invention is to provide cellulose fibers which are excellent in the dirt removability and which are free from impairment of properties due to repeated laundry, a process for preparing the cellulose fibers and a product thereof.

A second object of the invention is to provide a product of synthetic fibers which are excellent in the antistatic property and the dirt removability, and a technique for preparing said product of synthetic fibers with safety and ease.

Other features of the present invention will become apparent from the following description.

According to the present invention, there are provided liquid ammonia-treated cellulose fibers whose partial or entire exterior is coated with an ester of (A) a polycarboxylic acid having at least three carboxyl groups and (B) a hydrophilic polyol having an oxyethylene group or groups and at least two alcoholic hydroxyl groups and/or which fibers are impregnated with said ester.

The cellulose fibers of the present invention can be prepared by a process comprising the steps of treating cellulose fibers with liquid ammonia, depositing an ester of (A) a polycarboxylic acid having at least three carboxyl groups (hereinafter referred to as "present polycarboxylic acid") and (B) a hydrophilic polyol having an oxyethylene group or groups and at least two alcoholic hydroxyl groups (hereinafter referred to as "present polyol") on partial or entire exterior of liquid ammonia-treated cellulose fibers and/or impregnating the fibers with said ester, or by a process comprising the steps of depositing the present polycarboxylic acid and the present polyol on partial or entire exterior of liquid ammonia-treated cellulose fibers, and/or impregnating the fibers with the present polycarboxylic acid and the present polyol, and heating the fibers (these steps being hereinafter called "esterification treatment").

A product of cellulose fibers according to the present invention can be prepared by (1) treating the cellulose fibers with liquid ammonia, subjecting the fibers to esterification treatment and making the fibers into a product thereof by a conventional method or (2) treating the cellulose fibers with liquid ammonia, making the fibers into a product thereof by a conventional method and subjecting the product to esterification treatment.

The cellulose fibers of the invention and a product thereof are outstanding in the dirt removability and the property of maintaining the dirt removability without impairment even on exposure to repeated laundry (hereinafter called "laundry durability"). Dirt is unlikely to cling to the cellulose fibers of the present invention and products thereof. Examples of dirt are oily dirt derived from motor oil, machine oil, grease, lipstick, edible-oil, shoe polish, wax, sebum (so-called dirt on the collar), and aqueous dirt derived from mud, Indian ink, carbon (pencil), foods, seasonings (soy sauce, Worcester sauce, ketchup, curry, sauce for roast meat, etc.), and beverages (green tea, coffee, etc.). Even if dirt should come to lie on the cellulose fibers of the invention, the dirt would be scarcely likely to adhere to the fibers due to the remarkable dirt removability of the fibers.

According to the invention, there is also provided a product of synthetic fibers coated with an ester of (A) the present polycarboxylic acid and (B) the present polyol.

The products of synthetic fibers according to the invention have a high antistatic property and a good laundry durability and are substantially free from the reduction of antistatic property even when exposed to repeated washing. Dirt is unlikely to stick to the products of synthetic fibers according to the invention, examples of dirt being oily dirt derived from motor oil, machine oil, grease, lipstick, edible oil, shoe polish, wax, sebum (so-called dirt on the collar), and aqueous dirt derived from mud, Indian ink, carbon (pencil), foods, seasonings (soy sauce, Worcester sauce, ketchup, curry, sauce for roast meat, etc.), and beverages (green tea, coffee, etc.). Even if dirt should come to lie on the synthetic fiber products of the invention, the dirt would scarcely tend to cling to the products due to the outstanding dirt removability of the fibers. The products of synthetic fibers according to the invention are excellent in the water-absorbing capacity and have a good feel of course when the products are produced by mix-spinning synthetic fibers and cellulose fibers or even when the products are produced without using cellulose fibers.

According to the processes of the present invention, the desired cellulose fibers, products of cellulose fibers and products of synthetic fibers can be prepared with safety and ease.

Further, the present polycarboxylic acid and the present polyol to be used in the present invention are non-toxic and non-volatile and therefore are free from problems of hygiene and working environments.

Discussed below are the improved cellulose fibers of the present invention, processes for preparing the same and products of cellulose fibers.

The term "cellulose fibers" used herein refers to natural cellulose fibers such as cotton and hemp, regenerated cellulose fibers such as rayon, and fibers produced by mix-spinning these fibers. The cellulose fibers of the present invention include not only the foregoing fibers but those made by primary processing of these fibers such as threads, knit, textile, knitting, non-woven fabric, etc. The term "product of cellulose fibers according to the invention" used herein means products produced by further processing the foregoing cellulose fibers such as clothes, beddings, interior goods, etc.

In the practice of the invention, the cellulose fibers of the invention or products thereof can be mix-spun, twisted or knitted together with the cellulose-free synthetic fibers.

Examples of cellulose-free synthetic fibers include a wide variety of those heretofore known, such as the synthetic fibers made of polyester, liquid crystal polyester, polyamide, liquid crystal polyamide, acryl, polyethylene, polypropylene, Spandex or the like. Among said synthetic fibers, those of polyester, polyamide, acryl or polypropylene are preferred and those of polyester are more preferred.

In mix-spinning the cellulose fibers and said synthetic fibers, the mix-spinning ratio is not specifically limited, but the synthetic fibers may be used in a ratio of up to 80% by weight, preferably up to 70% by weight, based on the total fibers.

For treating the cellulose fibers with liquid ammonia according to the invention, a wide variety of conventional methods can be used and include, for example, the method disclosed in Japanese Unexamined Patent Publication No.152,595/1977, "Why Cotton ?", Commodity Knowledge of Cotton Products (published by Japanese Cotton Industry Promotion Association, 1994), etc.

For example, the liquid ammonia-treated cellulose fibers to be used in the invention can be prepared by immersing cellulose fibers in liquid ammonia to swell the fibers and removing ammonia from the swollen fibers. Swelling occurs by immersion of fibers in liquid ammonia for 0.1 to 200 seconds, preferably 5 to 30 seconds. The removal of ammonia can be done by any of dry steam method and water method.

According to the dry steam method, liquid ammonia is vaporized for removal by contact of the fibers with a high speed roller in treating the fibers with liquid ammonia. In the practice of the invention, a method can be used which comprises accelerating the removal of ammonia by water vapor or a thin layer of water after contact with a high speed roller. The water method comprises removing ammonia using water as a medium after treatment with liquid ammonia. Stated more specifically, the method comprises washing the fibers with low temperature water and then with warm water and drying them by a high temperature cylinder.

The cellulose fibers of the invention are subjected to esterification treatment after treatment with liquid ammonia. The esterification treatment is described below in detail.

Examples of the present polycarboxylic acid for use in the invention include a wide range of conventional polycarboxylic acids which have at least 3 carboxyl groups, such as aliphatic polycarboxylic acids, alicyclic polycarboxylic acids, aromatic polycarboxylic acids, etc. These polycarboxylic acids may have a hydroxyl group, halogen group, carbonyl group and carbon-carbon double bonds.

More specific examples of the present polycarboxylic acids are tribasic acids such as tricarballylic acid, aconitic acid, methylcyclohexene tricarboxylic acid and citric acid, tetrabasic acids such as butanetetracarboxylic acid, cyclopentanetetracarboxylic acid, tetrahydrofurantetracarboxylic acid and an ene adduct of methyl tetrahydrophthalate with maleic acid, trimellitic acid, pyromellitic acid, biphenyltetracarboxylic acid, benzophenonetetracarboxylic acid, diphenylsulfonetetracarboxylic acid and like aromatic polycarboxylic acids, tetracarboxylic acids prepared from styrene and maleic anhydride by Diels-Alder reaction and ene reaction, etc. These polycarboxylic acids can be used either alone or in combination. Among these polycarboxylic acids, water-soluble polycarboxylic acids such as tricarballylic acid, aconitic acid and citric acid are preferred because of high workability. Butane-tetracarboxylic acid which is water-soluble tetrabasic acid can achieve the highest effect and hence is more preferred.

The present polyols to be used in the invention include a wide variety of conventional polyols which have an oxyethylene group (or groups) and at least 2 alcoholic hydroxyl groups. Specific examples are polyethylene oxide, polypropylene oxide, adducts of ethylene oxide with compounds having at least 2 active hydrogen atoms such as amines, phenols, alcohols or the like. These polyols can be used either alone or in combination.

Examples of compounds having at least 2 active hydrogen atoms which can be used in the invention are neopentyl glycol, methylpentanediol, trimethylpentanediol and like diols having 5 to 12 carbon atoms and their branched alcohols; polypropylene glycol, polymers of 1,2-butylene oxide, poly(1,4-butylene glycol) and like polyether alcohols; glycerin, diglycerin, triglycerin, polyglycerin, trimethylolethane, trimethylolpropane, pentaerythritol, dipentaerythritol and like alcohols having at least 3 hydroxyl groups; cyclohexanediol, cyclohexanedimethanol, hydrogenated bisphenol A, spiroglycol, geometrical isomers thereof and like alicyclic alcohols; xylitol, sorbitol, mannitol, erythritol and like reducing sugars; xylose, sorbose, arabinose, ribose, erythrose, galactose, sorbitan and like monosaccharides; lactose, sucrose, maltose and like disaccharides; hydroquinone, resorcin, catechol, bisphenol A, bisphenol S, phenol novolak, cresol novolak and like phenols; ammonia, monoalkylamine having 1 to 22 carbon atoms, alkylenediamine, alkylenetriamine, aniline, o-, m-, p-phenylenediamine, xylylenediamine, diaminodiphenylmethane, diaminodiphenylsulfone, diaminodiphenyl ether, diaminodiphenyl ketone and polycondensate of aniline and formalin.

Polyethylene glycol and adducts of ethylene oxide such as bisphenol A, pentaerythritol, ethylenediamine or the like are the most preferred because of their effects, workability, availability of raw materials and good feel of finished products.

Polyester polyols prepared from said polyols and aliphatic dicarboxylic acid having 2 to 12 carbon atoms or aromatic dicarboxylic acid can be used as the present polyol. Among these polyester polyols, those at least soluble in a solvent, preferably in water are desirable. The polyols which can be emulsified or solubilized with a surfactant although insoluble in water can be used.

The present polyol preferably has a molecular weight of 200 to 20,000. Even a polyol having a molecular weight of less than 200 can be preferably used in the present invention when mixed with a polyol more than 200 in molecular weight to give mixed polyols with an average molecular weight within said range. Even a polyol having a molecular weight of more than 20,000 can be preferably used in the present invention when mixed with a polyol less than 20,000 in molecular weight to give mixed polyols having an average molecular weight within said range. Further in the present invention, the present polyol can be used as mixed with a compound containing said active hydrogen atoms as such or as mixed with an adduct of a small number of moles of ethylene oxide with said compound having a molecular weight of less than 200. The present polyol 400 to 2,000 in molecular weight is more preferred.

The ester to be deposited on and/or diffused into the liquid ammonia-treated cellulose fibers is an ester of the present polycarboxylic acid and the present polyol which has at least two carboxyl groups in one molecule. Typical examples of the structure of such polyester are as follows.

$$(A_1)—[(B)—(A_2)]_l—(B)—(A_1) \quad (1)$$

$$(B)—[(A_2)—(B)]_m—(A_2)—B \quad (2)$$

$$(A_1)—[(B)—(A_2)]_n—B \quad (3)$$

wherein $A_1$ is a terminal group derived from the present polycarboxylic acid; when the present polycarboxylic acid is tricarboxylic acid, it is $(HO_2C)_2(R)CO_2$— and when it is tetracarboxylic acid, it is $(HO_2C)_3(R)CO_2$— wherein R is a polycarboxylic acid residue, $A_2$ is a diester group derived from the present polycarboxylic acid, B is a residue derived from the present polyol, and l, m and n are integers of 0 to 500.

The ester to be used in the present invention is preferably a water-soluble ester from the viewpoints of the properties and workability. The most preferred among such esters is an ester of polyethylene glycol with 1,2,3,4-butanetetracarboxylic acid, that is, the ester having the structure as shown below in the foregoing formulas (1) to (3).

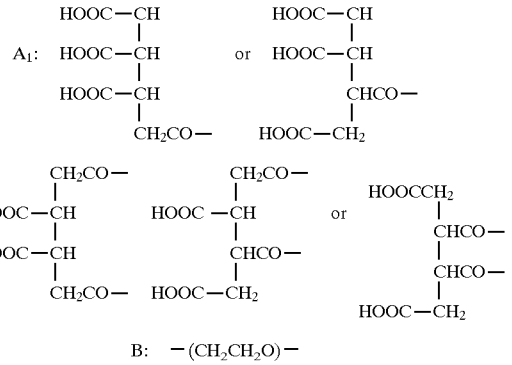

wherein o is an integer of 5 to 500.

Said ester can be prepared by dehydration esterification of the present polycarboxylic acid and the present polyol. As to the proportions of the present polycarboxylic acid and the present polyol used in the preparation of the ester, 0.01 to 20 moles, preferably 0.25 to 4 moles, more preferably 0.5 to 1 mole, of the present polycarboxylic acid, per mole of alcoholic hydroxyl group of the polyol. The esterification may be conducted in the absence of a solvent or in the presence of a known catalyst. It is preferred not to use a solvent from the standpoint of the workability. The catalyst to be optionally used is preferably the same substance as a neutralizing agent described later and incorporated into a treating solution in use for depositing the ester on, and/or diffusing the ester into, the liquid ammonia-treated cellulose fibers. The dehydration esterification can be carried out by mixing the two components, heating them to about 80 to about 200° C. and optionally distilling off the produced water. The reaction pressure in the dehydration esterification may be atmospheric pressure or reduced pressure.

In the present invention, the ester described above is deposited on part or the entire area of the surface of the liquid ammonia-treated cellulose fibers and/or diffused into the fibers. The amount of the ester deposited and/or internally diffused is variable depending on the type of the ester or other factors and indeterminable, but is 0.01 to 30% by weight, preferably 1 to 20% by weight, based on the liquid ammonia-treated cellulose fibers. A high dirt removability is exhibited when the amount of the ester used is in this range.

In depositing the ester on partial or entire exterior of the liquid ammonia-treated cellulose fibers and/or diffusing the ester into the fibers, the present polycarboxylic acid is preferably used in combination with the ester depending on the molar ratio of the present polycarboxylic acid and the present polyol composing the ester. Especially it is recommendable to add the present polycarboxylic acid in combination with the ester when less than 0.5 mole of the present polycarboxylic acid is employed per mole of the alcoholic hydroxyl group of the present polyol. The present polycarboxylic acid may be added in combination even when more than 0.5 mole is used per mole of the alcoholic hydroxyl group of the present polyol.

According to the present invention, the present polycarboxylic acid and the present polyol constituting the ester may be individually deposited on and/or diffused into the liquid ammonia-treated cellulose fibers, instead of depositing the ester on and/or diffusing the ester into the liquid ammonia-treated cellulose fibers. As to the proportions of the present polycarboxylic acid and the present polyol separately used in this case, 0.01 to 20 moles, preferably 0.25 to 4 moles, more preferably 0.5 to 1 mole, of the present polycarboxylic acid is used per mole of alcoholic hydroxyl group of the polyol. The amount of the present polycarboxylic acid deposited and/or internally diffused is variable depending on the type of the present polycarboxylic acid or other factors and indeterminable, but is 0.01 to 20% by weight, preferably 0.1 to 10% by weight, based on the liquid ammonia-treated cellulose fibers to be processed. The amount of the present polyol deposited and/or internally diffused is variable depending on the type of the present polyol or other factors and indeterminable, but is 0.1 to 30% by weight, preferably 1 to 20% by weight, based on the liquid ammonia-treated cellulose fibers to be processed. A high dirt removability is exhibited when the amount of each of the two components deposited and/or internally diffused is in this range.

In the practice of the present invention, a conventional fiber-softening agent as well as said components may be deposited on and/or diffused into the cellulose fibers. For example, if a polyethylene emulsion or a fiber-softening silicone is deposited on the cellulose fibers or products thereof, an improved feel and enhanced persistence would be imparted to the cellulose fibers or products thereof.

Fiber-softening silicones are compounds having, as a basic skeleton, dimethylpolysiloxane containing at least one aliphatic hydroxyl group and/or amino group and/or carboxyl group in the molecule. Preferred silicones are so-called amino-modified silicone, polyether-modified silicone, epoxy-modified silicone and carboxyl-modified silicone.

An amino-modified silicone may color treated cellulose fibers or products thereof depending on the type or amount of the silicone. A polyether-modified silicone, epoxy-modified silicone and carboxyl-modified silicone are preferable. These silicones are available in the form of the solid as produced, an emulsion or an aqueous silicone and can be used as such.

The amount of the fiber-softening agent deposited and/or internally diffused is 0.01 to 50% by weight, preferably 0.1 to 10% by weight, based on the product of cellulose fibers to be processed.

The ester or the present polycarboxylic acid, the present polyol and the like may be deposited on and/or diffused into the cellulose fibers by various conventional methods such as dipping, spraying, coating and the like. In the practice of the invention, the so-called dipping technique is preferred in which the cellulose fibers to be treated are dipped into a treating solution containing the ester or the present polycarboxylic acid, the present polyol, etc. The dipping technique is described below in detail.

The concentration of the ester or the concentrations of the present polycarboxylic acid and the present polyol in the treating solution can be determined by calculation from the squeezing ratio of the treating solution and the amount of the treating solution required to be carried.

It is suitable to adjust the treating solution to a pH of 0 to 6, preferably 2 to 5. If the treating solution has a pH in said range, the cellulose fibers would be given higher dirt removability and enhanced laundry durability. The pH range of the treating solution can be adjusted by adding a neutralizing agent, namely a suitable alkali or salt, to the treating solution.

Examples of the neutralizing agent to be used for the adjustment of a pH are sodium hydroxide, sodium bicarbonate, sodium carbonate, sodium percarbonate, sodium borate, sodium metaborate, sodium borohydride, sodium silicate, sodium metasilicate, sodium sulfate, sodium sulfite, sodium thiosulfate, sodium phosphate, sodium metaphosphate, sodium polyphosphate, sodium pyrophosphate, sodium phosphite, sodium hypophosphite, sodium formate, sodium acetate, sodium malate, sodium tartrate and sodium lactate. Salts of potassium, salts of ammonium, and salts of methylamine, dimethylamine, trimethylamine, triethylamine or like volatile lower amines can be used in place of said sodium salts. These neutralizing agents can be used either alone or in combination.

The amount of the neutralizing agent used is variable depending on the type and the dissolution amount of the ester or the present polycarboxylic acid but is about 0.1 to about 10% by weight, calculated as the concentration in the treating solution.

The solvent constituting the treating solution may be an organic solvent but preferably is water from the viewpoints of safety and costs. The form of the treating solution is not specifically limited insoafar as the desired effect can be achieved. A suitable form may be a solution or an emulsion. An aqueous solution is preferred from the viewpoints of treating efficiency and safety.

The liquid ammonia-treated cellulose fibers are dipped in the treating solution prepared above to deposit the ester or the present polycarboxylic acid, the present polyol and like components on the fibers and/or to diffuse them into the fibers and then usually the fibers are heated after squeezing, whereby the cellulose fibers of the present invention are produced.

Since the treating solution can be deposited on or diffused into the fibers at a sufficiently high rate, the dipping time and the bath temperature are not specifically limited. Usually the dipping time is 0.1 to 300 seconds, and the bath temperature is 10° to 40° C. Squeezing methods are different depending on the product to be processed, and a suitable method and a proper squeezing ratio can be selected. Usually a preferred squeezing ratio is 30 to 200%.

The cellulose fibers are dried after dipping and squeezing. The drying temperature is 40° to 150° C. and the drying time is selected according to the temperature.

In the invention, subsequently there are heat-treated the cellulose fibers externally or internally having the ester or the present polycarboxylic acid, the present polyol and other components. The heat treatment causes esterification reaction of the present polycarboxylic acid and the present polyol sticking to the fibers for conversion into an ester, and not only the surface of the fibers is partly or completely coated with the ester, but also a reaction occurs between the carboxyl group of the present polycarboxylic acid and the hydroxyl group of the cellulose fibers to give a firm coating film of the reaction product chemically bonded to the exterior and/or the interior of individual fibers. When the ester prepared by the esterification of the present polycarboxylic acid and present polyol is used, the same coating film is formed. If other components than the present polycarboxylic acid and present polyol or the ester, such as a fiber-softening silicone, are deposited on and/or diffused into the fibers, the components are reacted by heat treatment together with the present polycarboxylic acid and the present polyol or the ester to produce a reaction product as said coating film.

The heat-treating temperature is 100° to 250° C., preferably 120° to 200° C. The heat-treating time is 20 seconds to 1 hour. The heat treatment under these conditions provides the cellulose fibers of the present invention with improved dirt removability and enhanced laundry durability.

The cellulose 1086Xfibers processed are subjected to further treatments such as washing with water, soaping and addition of fiber-softening agent and others to give the desired product of cellulose fibers. If the product of cellulose fibers is a thread, the thread is made into textile, knit, non-woven fabric or the like by conventional methods, and these products are processed into clothes, interior goods, bedding or other end products.

Examples of products of cellulose fibers according to the present invention are outer clothing, intermediate clothing and under clothing. More specific examples are jackets, trousers, skirts, shirts, blouses, nightwears, underwears, stockings, aprons, polo shirts, white robes, gloves, etc. Further examples are embroidery threads, machine cotton, gauzes, flu masks, handkerchiefs, cotton for bedding, pot-holding pads, sneakers, linings and insoles for shoes, towels, dishcloths, covers for armchairs, outer cloth materials for chairs, cushions, bedding covers, blankets made of cotton, blankets made of toweling, etc.

In the present invention, the cellulose fibers are, as described above, treated with liquid ammonia, subjected to esterification treatment and are made into a product of cellulose fibers by conventional methods. The product of cellulose fibers according to the invention can be produced also by the following processes.

A process is employable which comprises treating the cellulose fibers with liquid ammonia, making the liquid ammonia-treated cellulose fibers into a product thereof, depositing the ester of the present polycarboxylic acid and the present polyol on partial or entire exterior of cellulose fibers and/or diffusing the ester into the fibers, and finally heating the fibers, whereby a product thereof is produced. Another process employable comprises treating the cellulose fibers with liquid ammonia, making the liquid ammonia-treated cellulose fibers into a product thereof, depositing the present polycarboxylic acid and the present polyol on partial or entire exterior of cellulose fibers and/or diffusing them into the fibers, and finally heating the fibers, whereby a product thereof is produced. The conditions for the liquid ammonia treatment, deposition or diffusion of the ester or the present polycarboxylic acid and present polyol and heat treatment are the same conditions as described hereinbefore for the cellulose fibers.

Next, the product of cellulose-free synthetic fibers according to the invention and a process for preparing the product are described below.

Products of synthetic fibers according to the invention include, for example, filaments made of cellulose-free synthetic fibers or made by mix-spinning said synthetic fibers and cellulose fibers, processed products of said filaments, such as threads, textile, knit, non-woven fabric, clothes, curtains, etc.

The cellulose-free synthetic fibers and the cellulose fibers are as described above. The cellulose fibers to be used herein are those untreated with ammonia. Preferred examples of said synthetic fibers are fibers made of polyester, polyamide, acryl or polypropylene. Among them, fibers of polyester are more preferred. Of said cellulose fibers, cotton is favorable. In the case of mixed fibers made by mix-spinning the synthetic fibers and the cellulose fibers, the mix-spinning ratio is suitably selected from the range in which the properties of the synthetic fibers are not impaired. It is desirable that the mixed fibers contain the cellulose fibers in an amount of less than 80% by weight, preferably less than 70% by weight, most preferably less than 50% by weight, based on the total fibers.

The product of synthetic fibers according to the invention can be produced by depositing the present polycarboxylic acid and the present polyol on the synthetic fibers and heat-treating the fibers.

The amount of the present polycarboxylic acid deposited on the product of synthetic fibers can be suitably selected over a wide range depending on its type, but is 0.01 to 20% by weight, preferably 0.1 to 10% by weight, based on the synthetic fiber product to be processed. If the amount of the present polycarboxylic acid deposited is below the range, the synthetic fiber product tends to achieve lower effects than as contemplated in the invention, e.g. reduced antistatic effect and dirt removability, whereas a more amount are unlikely to produce effects corresponding to the amount, and hence it is uneconomical.

The amount of the present polyol deposited on the product of synthetic fibers is 0.1 to 30% by weight, preferably 1 to 20% by weight, based on the synthetic fiber product to be processed. If the amount of the polyol deposited is below the range, the synthetic fiber product tends to show decreased antistatic effect and dirt removability, whereas a more amount is unlikely to produce effects corresponding to the amount and hence it is uneconomical.

According to the present invention, at least one compound selected from compounds represented by the formula (4) shown below and cationic celluloses is preferably deposited on the product of synthetic fibers together with the present polycarboxylic acid and the present polyol:

$$Xa—A—Yb \quad (4)$$

wherein A is an aliphatic hydrocarbon group, an aromatic hydrocarbon group, an oxyalkylene group having 2 to 4 carbon atoms or a poly(polymerization degree: 2 to 20)oxyalkylene group, X is an alcoholic hydroxyl group, or an amino group, Y is $—SO_3M$ group, $—OSO_3M$ group, $—N(R^1)(R^2)$ group or $—N^+(R^3)(R^4)(R^5)\cdot X^-$ in which M is a hydrogen atom, an alkali metal atom, an ammonium base, an alkylamine base or an alkanolamine base, $X^-$ is a halogen ion, a perchloric acid ion, an alkylsulfonic acid ion or an alkyl arylsulfonic acid ion, $R^1$, $R^2$, $R^3$, $R^4$ and $R^5$ are the same or different and each represents a hydrogen atom, an aliphatic group of 1 to 22 carbon atoms or an aromatic group, both of the aliphatic group and the aromatic group optionally having an amide group or an oxyalkylene group, a and b are integers of 1 to 3, provided that when A is an oxyalkylene group of 2 carbon atoms and X is an alcoholic hydroxyl group, a must not be 2 or 3 and provided that the compound wherein $R^1$ and $R^2$ are both hydrogen atoms and the compound wherein $R^3$, $R^4$ and $R^5$ are all hydrogen atoms are excluded. The deposition of the compound(s) increases the effect as contemplated by the invention.

The compounds of the formula (4) which can be used include a wide variety of conventional compounds which have at least one amino group and/or an alcoholic hydroxyl group. Specific examples are compounds which pertain to the groups described below.

(1) Sulfonic acids containing at least one amino group and/or alcoholic hydroxyl group and salts thereof Examples of the compounds in this group are isethionic acid, aminobenzenesulfonic acid, aminonaphthalenesulfonic acid, adducts of these acids with alkylene oxide of 2 to 4 carbon atoms, and alkali metal salts or amine salts of adducts of phenolsulfonic acid, naphtholsulfonic acid or the like with alkylene oxide of 2 to 4 carbon atoms. Among them, it is preferred to use isethionic acid or an adduct of said acid with ethylene oxide, and salts of alkali metals with an adduct of phenolsulfonic acid with ethylene oxide in order to provide the processed cloth capable of maintaining white color.

(2) Amines having at least one amino group and/or alcoholic hydroxyl group

The amine is represented by the formula (5) or (6)

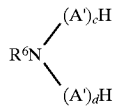

(5)

wherein $R^6$ is an alkyl group of 1 to 22 carbon atoms or an alkenyl group of 1 to 22 carbon atoms, both of the alkyl group and the alkenyl group optionally having an amide group or an oxyalkylene group of 2 to 4 carbon atoms, A' is an oxyalkylene group of 2 to 3 carbon atoms, and c and d are integers of at least 1, and c+d is an integer of at least 2, preferably 2 to 20, and

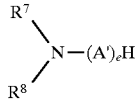

(6)

wherein $R^7$ and $R^8$ are the same or different, and each represents a hydrogen atom, an alkyl group of 1 to 22 carbon atoms or an alkenyl group of 1 to 22 carbon atoms, both of the alkyl group and the alkenyl group optionally having an amide group or an oxyalkylene group of 2 to 4 carbon atoms, provided that $R^7$ and $R^8$ together can not be hydrogen atoms, A' is as defined above, and e is an integer of at least one, preferably an integer of 1 to 20.

(3) Ammonium salts containing at least one amino group and/or alcoholic hydroxyl group The compound is represented by the formula (7) or (8)

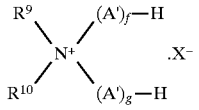

(7)

wherein $R^9$ and $R^{10}$ are the same or different, and each represents a hydrogen atom, an alkyl group of 1 to 22 carbon atoms or an alkenyl group of 1 to 22 carbon atoms, both of the alkyl group and the alkenyl group optionally having an amide group or an oxyalkylene group of 2 to 4 carbon atoms, provided that $R^9$ and $R^{10}$ together can not be hydrogen atoms, A' is as defined above, X is a halogen ion (such as Cl, Br or I), a perchloric acid ion, an alkylsulfonic acid ion (such as monomethyl sulfate residue), or an alkyl arylsulfonic acid ion (such as dodecylbenzene-sulfonic acid ion), f and g are integers of at least 1, and f+g are an integer of at least 2, preferably 2 to 20, and

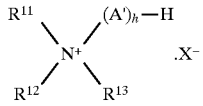

(8)

wherein $R^{11}$, $R^{12}$ and $R^{13}$ are the same or different, and each represents a hydrogen atom, an alkyl group of 1 to 22 carbon atoms or an alkenyl group of 1 to 22 carbon atoms, both of the alkyl group and the alkenyl group optionally having an amide group or an oxyalkylene group of 2 to 4 carbon atoms, provided that $R^{11}$, $R^{12}$ and $R^{13}$ together can not be hydrogen atoms, A' and X are as defined above, and h is an integer of at least 1, preferably 1 to 20.

To avoid the yellowing of the processed fiber product, tertiary amine is preferred among these amines. Of ammonium salts, quaternary ammonium salt is preferable. Quaternary ammonium salt is the most preferred because it is excellent in the antistatic effect and dirt removability. It is desirable that these amines or ammonium salts be soluble in water or be in a stably emulsified state in the treating solution wherein the present polycarboxylic acid and the present polyol are dissolved. Even the amines and ammonium salts which can not be emulsified by themselves can be used if they are made emulsifiable by the addition of a surfactant.

Useful cationic celluloses include, for example, O-[2-hydroxy-3-(trimethylammonio)propyl]-hydroxyethyl cellulose chloride.

The amount of the compound of the formula (4) and/or the cationic cellulose deposited is 0.01 to 100 mole %, preferably 0.1 to 20 mole %, based on the present polycarboxylic acid.

In the practice of the invention, the antistatic effect of the synthetic fiber product according to the present invention can be markedly increased by depositing a conventional antistatic agent on the product.

Examples of antistatic agents to be used are anionic surfactants such as those prepared from alkyl sulfate, alkyl amidosulfate, alkyl sulfonate, alkyl amidosulfonate, alkyl ether sulfonate, alkyl arylsulfonate, alkyl phosphite, alkyl phosphate and the like, cationic surfactants such as hydrocarbonate, hydrochloride, perchlorate, acetate, citrate, alkylpyridinium salt, alkylamidopyridinium salt, alkyl ether pyridinium salts or the like, e.g. those from alkyl amidoamine, alkyltrimethyl, alkyldimethylbenzyl, alkylamide, quaternary ammonium salt, alkyloxazoline, alkylimidazoline, aminoethylimidazoline, dihydroindole, alkylaminotriazole, alkyldioxane and the like, and amphoteric surfactants such as those from betaine, imidozoline, sulfate, sulfonic acid, phosphate and the like.

In the practice of the invention, a conventional fiber-softening agent as well as said components may be deposited on the product of synthetic fibers. For example, if a polyethylene emulsion or a fiber-softening silicone is deposited on the product of synthetic fibers, an improved feel and enhanced persistence would be imparted to the product of synthetic fibers.

The fiber-softening silicones are compounds having, as a basic skeleton, dimethylpolysiloxane containing at least one aliphatic hydroxyl group and/or amino group in the molecule. These silicones are generally called amino-modified silicone (formula (9)), or polyether-modified silicone (formula (10)) and are commercially available.

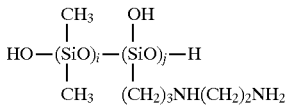

(9)

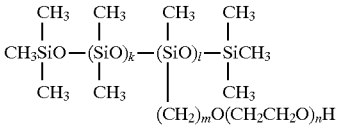

(10)

An amino-modified silicone may color the treated fiber product depending on the type or amount of the silicone. A polyether-modified silicone is preferred to such silicone. An epoxy-modified silicone is produced substantially via an aliphatic hydroxyl group and thus is included in said fiber-softening silicones. These silicones are available in the form of the solid as produced or an emulsion, and can be used as such.

The amount of the fiber-softening agent deposited is 0.01 to 50% by weight, preferably 0.1 to 10% by weight, based on the product of synthetic fibers to be processed.

The present polycarboxylic acid, the present polyol and other components can be deposited on the product of synthetic fibers by various conventional methods such as dipping, spraying, coating or the like. In the practice of the invention, the so-called dipping technique is preferred in which the product of synthetic fibers to be treated is dipped into a treating solution containing the present polycarboxylic acid, the present polyol and the like. The dipping technique is as described above.

The synthetic fibers are dried after dipping and squeezing. The drying temperature is 40° to 150° C. and the drying time is selected according to the temperature.

In the invention, subsequently there is heat-treated a product of synthetic fibers having the present polycarboxylic acid, the present polyol and like components deposited thereon. The heat treatment causes esterification reaction of the present polycarboxylic acid and the present polyol sticking to the product of synthetic fibers for conversion into an ester with which the surface of synthetic fiber product is coated. If the product of synthetic fibers carries other components than the present polycarboxylic acid and the present polyol as deposited thereon, such as the compound of the formula (4), cationic cellulose and fiber-softening agent, these third components are reacted by heat treatment together with the present polycarboxylic acid and the present polyol, whereby a reaction product is produced to cover the product of synthetic fibers.

The heat-treating temperature is 100° to 250° C., preferably 120° to 200° C. The heat-treating time is 20 seconds to 1 hour. The product of synthetic fibers heat-treated under milder conditions is not imparted an enhanced antistatic effect or increased dirt removability, or improved laundry durability. Too severe conditions would result in degraded properties of synthetic fibers, and are likely to decrease the strength of fibers or to yellow them, hence the conditions outside said ranges are undesirable.

When required, the product of synthetic fibers thus processed is washed with water, soaped and provided with a fiber-softening agent to give the desired product. When the product is a filament or thread, it is made by a conventional method into an end product such as textile, knitting, nonwoven fabric, clothes, curtains, etc.

BEST MODE FOR CARRYING OUT THE INVENTION

The present invention is described below in more detail with reference to the Examples and Test Examples.

EXAMPLE 1

There was prepared an aqueous solution of 4% by weight of 1,2,3,4-butanetetracarboxylic acid (hereinafter referred to as "BTC"), 8% by weight of "Polyethylene Glycol #600" and 4% by weight of monosodium phosphate. A liquid ammonia-treated plain cotton fabric piece was immersed in the solution at 25° C. for 5 minutes and squeezed at a squeezing ratio of 60%. After drying at 100° C. for 10 minutes, the piece was heat-treated at 170° C. for 2 minutes, giving a heat-treated test fabric sample (processed fabric sample). The processed fabric sample was washed ten times to provide a washed fabric sample.

EXAMPLE 2

There was prepared an aqueous solution of 8% by weight of BTC, 15% by weight of "Polyethylene Glycol #1000", 8% by weight of carboxy-modified silicone, and 4% by weight of sodium malate. Using the solution as a treating solution, the same procedure as in Example 1 was repeated, giving a processed fabric sample and a washed fabric sample.

EXAMPLE 3

There was prepared an aqueous solution of 4% by weight of BTC, 8% by weight of an adduct of 18 moles of ethylene oxide with bisphenol A and 0.8% by weight of sodium carbonate. Using the solution as a treating solution, the same procedure as in Example 1 was repeated, giving a processed fabric sample and a washed fabric sample.

EXAMPLE 4

There was prepared an aqueous solution of 3% by weight of tricarballylic acid, 5% by weight of "Polyethylene Glycol #600" and 4% by weight of monosodium phosphate. Using the solution as a treating solution, the same procedure as in Example 1 was repeated, giving a processed fabric sample and a washed fabric sample.

EXAMPLE 5

There was prepared an aqueous solution of 3% by weight of citric acid, 5% by weight of "Polyethylene Glycol #6000" and 4% by weight of monosodium phosphate. Using the solution as a treating solution, the same procedure as in Example 1 was repeated except that heat treatment was conducted at 170° C. for 3 minutes, giving a processed fabric sample and a washed fabric sample.

EXAMPLE 6

There was prepared an aqueous solution of 4% by weight of BTC, 8% by weight of "Polyethylene Glycol #1000", 1% by weight of an adduct of 40 moles of ethylene oxide with pentaerythritol, 1% by weight of monosodium phosphate and 2% by weight of sodium lactate. Using the solution as a treating solution, the same procedure as in Example 1 was repeated, giving a processed fabric sample and a washed fabric sample.

EXAMPLE 7

There was prepared an aqueous solution of 8% by weight of BTC, 15% by weight of "Polyethylene Glycol #1000" and 4% by weight of sodium hypophosphite. Using the solution as a treating solution, the same procedure as in Example 1 was repeated, giving a processed fabric sample and a washed fabric sample.

EXAMPLE 8

A 4-necked flask reactor equipped with a stirrer was charged with 70 g (0.3 mole) of BTC, 150 g (0.15 mole) of "Polyethylene Glycol #1000" and 20 g of water. The temperature was elevated to 150° C. and the reaction system was placed under reduced pressure. While eliminating the produced water, the reaction was continued for 3 hours, giving a viscous liquid of an ester (hereinafter referred to as "ester A"). The ester was found to have a neutralization value of 246 (mg KOH/g) and an ester value of 65 (mg KOH/g).

An aqueous solution of 20% by weight of the above-obtained ester A and 4% by weight of sodium hypophosphite was prepared. Using the solution as a treating solution, the same procedure as in Example 1 was repeated, giving a processed fabric sample and a washed fabric sample.

EXAMPLE 9

A 4-necked flask reactor equipped with a stirrer was charged with 23.4 g (0.1 mole) of BTC, 100 g (0.2 mole) of "Polyethylene Glycol #1000" and 20 g of water. The temperature was elevated to 150° C. and the reaction system was placed under reduced pressure. While eliminating the produced water, the reaction was continued for 3 hours, giving a viscous liquid of an ester (hereinafter referred to as "ester B"). The ester was found to have a neutralization value of 104 (mg KOH/g) and an ester value of 81 (mg KOH/g).

An aqueous solution of 8% by weight of the above-obtained ester B, 4% by weight of BTC and 3% by weight of sodium lactate was prepared. Using the solution as a treating solution, the same procedure as in Example 1 was repeated, giving a processed fabric sample and a washed fabric sample.

Comparative Example 1

An aqueous solution of 8% by weight of "Polyethylene Glycol #600" and 4% by weight of monosodium phosphate was prepared. Using the solution as a treating solution, the same procedure as in Example 1 was repeated, giving a processed fabric sample and a washed fabric sample.

Comparative Example 2

An aqueous solution of 4% by weight of BTC and 4% by weight of monosodium phosphate was prepared. Using the solution as a treating solution, the same procedure as in Example 1 was repeated, giving a processed fabric sample and a washed fabric sample.

Comparative Example 3

The same procedure as in Example 1 was performed except that heat treatment was not conducted, giving a processed fabric sample and a washed fabric sample.

Comparative Example 4

A plain cotton fabric piece mercerized with an aqueous solution of sodium hydroxide (namely a plain cotton fabric piece not treated with liquid ammonia) was dipped into the treating solution of Example 1 at 25° C. for 5 minutes, and squeezed at a squeezing ratio of 60%. After drying at 100° C. for 10 minutes, the piece was heat-treated at 170° C. for 2 minutes, giving a processed fabric sample. The processed fabric sample was washed ten times to provide a washed fabric sample.

Comparative Example 5

A plain cotton fabric piece was treated with liquid ammonia, giving a processed fabric sample which was washed 10 times to provide a washed fabric sample.

Comparative Example 6

A plain cotton fabric piece mercerized with an aqueous solution of sodium hydroxide was dipped into the treating solution of Example 1 at 25° C. for 5 minutes, and squeezed at a squeezing ratio of 60%. After drying at 100° C. for 10 minutes, the piece was heat-treated at 170° C. for 2 minutes and then treated with liquid ammonia, giving a processed fabric sample. The processed fabric sample was washed ten times to provide a washed fabric sample.

Test Example 1

The washed fabric samples obtained above in Examples 1 to 9 and Comparative Examples 1 to 6 were tested as follows.

(1) Dirt removability test

The washed fabric sample was fouled at specified spots with lipstick, soiled motor oil and Indian ink and was left to stand for 2 hours to provide a fouled fabric sample. Then the fouled fabric sample was washed once or twice to evaluate the dirt removability according to the following 5-grade rating:

1. No dirt removed
2. Dirt slightly removed
3. Dirt partly removed
4. Dirt markedly removed
5. Only traces of dirt recognizable, or dirt scarcely recognizable.

The results are shown below in Table 1.

TABLE 1

| | Lipstick | | Soiled motor oil | | Indian ink | |
|---|---|---|---|---|---|---|
| | Washed once | Washed twice | Washed once | Washed twice | Washed once | Washed twice |
| Ex. 1 | 3 | 3 | 4 | 5 | 3 | 4 |
| Ex. 2 | 3 | 3 | 4 | 5 | 3 | 4 |
| Ex. 3 | 3 | 3 | 4 | 5 | 3 | 4 |
| Ex. 4 | 3 | 3 | 3 | 3 | 3 | 4 |
| Ex. 5 | 3 | 3 | 3 | 3 | 3 | 4 |
| Ex. 6 | 3 | 3 | 4 | 5 | 3 | 4 |
| Ex. 7 | 3 | 3 | 4 | 5 | 3 | 4 |
| Ex. 8 | 3 | 3 | 4 | 5 | 3 | 4 |
| Ex. 9 | 3 | 3 | 4 | 5 | 3 | 4 |
| Comp. Ex. 1 | 1 | 1 | 1 | 1 | 1 | 1 |
| Comp. Ex. 2 | 1 | 1 | 1 | 1 | 1 | 1 |
| Comp. Ex. 3 | 1 | 1 | 1 | 1 | 1 | 1 |
| Comp. Ex. 4 | 1 | 1 | 1 | 1 | 1 | 1 |
| Comp. Ex. 5 | 1 | 1 | 1 | 1 | 1 | 1 |
| Comp. Ex. 6 | 1 | 1 | 1 | 1 | 1 | 1 |

(2) Antifouling property test

A solution containing 0.3 ml/liter of Indian ink and 2.5 g/liter of a household detergent was prepared and placed into a washing machine. The washed fabric sample was washed by the machine to evaluate the antifouling property of the sample according to 5-grade rating by JIS dirt grey scale. Grade 1 is the lowest degree of antifouling property and Grade 5 is freedom from dirt. The results are shown in Table 2.

TABLE 2

| | |
|---|---|
| Example 1 | Grade 4–5 |
| Example 2 | Grade 4–5 |
| Example 3 | Grade 4–5 |
| Example 4 | Grade 4–5 |
| Example 5 | Grade 4–5 |
| Example 6 | Grade 4–5 |
| Example 7 | Grade 4–5 |
| Comp. Ex. 1 | Grade 1 |
| Comp. Ex. 2 | Grade 2 |
| Comp. Ex. 3 | Grade 1 |
| Comp. Ex. 4 | Grade 1 |
| Comp. Ex. 5 | Grade 1 |
| Comp. Ex. 6 | Grade 1 |

EXAMPLE 10

There was prepared an aqueous solution of 4% by weight of BTC, 8% by weight of "Polyethylene Glycol #600" and 4% by weight of monosodium phosphate. A plain 100% polyester fabric piece was immersed in this solution at 25° C. for 5 minutes and squeezed at a squeezing ratio of 60%. The sample was dried at 100° C. for 10 minutes and heat-treated at 180° C. for 3 minutes, giving a heat-treated test fabric sample (processed fabric sample), which was washed ten times to provide a washed fabric sample.

EXAMPLE 11

There was prepared an aqueous solution of 4% by weight of BTC, 10% by weight of "Polyethylene Glycol #1000", 2% by weight of monosodium phosphate and 2% by weight of sodium hypophosphite. Using the solution as a treating solution, the same procedure as in Example 10 was performed, giving a processed fabric sample and a washed fabric sample.

EXAMPLE 12

There was prepared an aqueous solution of 2% by weight of BTC, 4% by weight of an adduct of 20 moles of ethylene oxide with pentaerythritol, 1% by weight of monosodium phosphate and 2% by weight of sodium hypophosphite. Using the solution as a treating solution, the same procedure as in Example 10 was performed, giving a processed fabric sample and a washed fabric sample.

EXAMPLE 13

There was prepared an aqueous solution of 4% by weight of BTC and 8% by weight of an adduct of 18 moles of ethylene oxide with bisphenol A. Using the solution as a treating solution, the same procedure as in Example 10 was performed, giving a processed fabric sample and a washed fabric sample.

EXAMPLE 14

There was prepared an aqueous solution of 3% by weight of BTC, 4% by weight of an adduct of 18 moles of ethylene oxide with bisphenol A, 4% by weight of an adduct of 20 moles of ethylene oxide with ethylene-diamine, 1% by weight of monosodium phosphate and 2% by weight of sodium hypophosphite. Using the solution as a treating solution, the same procedure as in Example 10 was performed, giving a processed fabric sample and a washed fabric sample.

EXAMPLE 15

There was prepared an aqueous solution of 3% by weight of tricarballylic acid, 5% by weight of "Polyethylene Glycol #600" and 4% by weight of monosodium phosphate. Using the solution as a treating solution, the same procedure as in Example 10 was performed, giving a processed fabric sample and a washed fabric sample.

EXAMPLE 16

There was prepared an aqueous solution of 3% by weight of citric acid, 5% by weight of "Polyethylene Glycol #6001" and 4% by weight of monosodium phosphate. Using the solution as a treating solution, the same procedure as in Example 10 was performed with the exception of carrying out heat treatment at 200° C. for 3 minutes, giving a processed fabric sample and a washed fabric sample.

EXAMPLE 17

There was prepared an aqueous solution of 4% by weight of BTC, 8% by weight of an adduct of 18 moles of ethylene oxide with bisphenol A, 0.3% by weight of sodium isethionate and 4% by weight of sodium hypophosphite. Using the solution as a treating solution, the same procedure as in Example 10 was performed, giving a processed fabric sample and a washed fabric sample.

EXAMPLE 18

There was prepared an aqueous solution of 4% by weight of BTC, 8% by weight of an adduct of 18 moles of ethylene oxide with bisphenol A, 1.0% of lauryl dimethyl (hydroxyethyl) ammonium chloride and 4% by weight of sodium hypophosphite. Using the solution as a treating solution, the same procedure as in Example 10 was performed, giving a processed fabric sample and a washed fabric sample.

Comparative Example 7

There was prepared an aqueous solution of 2% by weight of "Polyethylene Glycol #600" and 4% by weight of monosodium phosphate. Using the solution as a treating solution, the same procedure as in Example 10 was performed, giving a processed fabric sample and a washed fabric sample.

Comparative Example 8

There was prepared an aqueous solution of 4% by weight of BTC and 4% by weight of monosodium phosphate. Using the solution as a treating solution, the same procedure as in Example 10 was performed, giving a processed fabric sample and a washed fabric sample.

Comparative Example 9

The same procedure as in Example 10 was repeated with the exception of not conducting heat treatment, giving a processed fabric sample and a washed fabric sample.

Test Example 2

To evaluate the antistatic property of the processed fabric samples and washed fabric samples obtained above in Examples 10 to 18 and Comparative Examples 7 to 9, the volt (V) of frictional electricity in the test fabric samples (processed fabric samples and washed fabric samples) was measured using a Kyo Dai-type frictional electrification tester. The processed fabric sample obtained in Comparative Example 8 was unable to undergo frictional electrification test since a solid substance was produced from the sample. The results are shown in Table 3.

TABLE 3

| | Volt of frictional electricity | |
|---|---|---|
| | Processed fabric sample | Washed fabric sample |
| Ex. 10 | 80 V | 130 V |
| Ex. 11 | 90 V | 160 V |
| Ex. 12 | 110 V | 150 V |
| Ex. 13 | 120 V | 150 V |
| Ex. 14 | 90 V | 130 V |
| Ex. 15 | 130 V | 400 V |
| Ex. 16 | 100 V | 680 V |
| Ex. 17 | 20 V | 60 V |
| Ex. 18 | 30 V | 70 V |
| Comp. Ex. 7 | 100 V | 5800 V |
| Comp. Ex. 8 | — | 6900 V |
| Comp. Ex. 9 | 70 V | 6500 V |

EXAMPLE 19

There was prepared an aqueous solution of 4% by weight of BTC, 8% by weight of "Polyethylene Glycol #1000", 1% by weight of an adduct of 40 moles of ethylene oxide with pentaerythritol, 1% by weight of monosodium phosphate and 2% by weight of sodium lactate. Using the solution as a treating solution, the same procedure as in Example 10 was repeated for treatment of a fabric piece made by mix-spinning of polyester and cotton (80/20), giving a processed fabric sample and a washed fabric sample.

EXAMPLE 20

There was prepared an aqueous solution of 4% by weight of BTC, 8% by weight of "Polyethylene Glycol #1000", 1% by weight of an adduct of 40 moles of ethylene oxide with pentaerythritol, 1% by weight of monosodium phosphate, 2% by weight of sodium lactate and 0.3% by weight of sodium isethionate. Using the solution as a treating solution, the same procedure as in Example 19 was performed, giving a processed fabric sample and a washed fabric sample.

Comparative Example 10

An aqueous solution of the same composition as in Example 19 was prepared with the exception of not using 4% by weight of BTC. Using the solution as a treating solution, the same procedure as in Example 19 was performed, giving a processed fabric sample and a washed fabric sample.

Comparative Example 11

An aqueous solution of the same composition as in Example 19 was prepared with the exception of not using "Polyethylene Glycol #1000" and the adduct of 40 moles of ethylene oxide with pentaerythritol. Using the solution as a treating solution, the same procedure as in Example 19 was performed, giving a processed fabric sample and a washed fabric sample.

Test Example 3

To evaluate the antistatic property of the processed fabric samples and washed fabric samples obtained above in Examples 19 and 20 and Comparative Examples 10 and 11, the volt (V) of frictional electricity in the test fabric samples (processed fabric samples and washed fabric samples) was measured using a rotary static tester of the Kyo Dai Chemistry Research Institute type (450 rpm×80 seconds). Table 4 shows the results of measurement in the atmosphere at a temperature of 20° C. and a relative humidity of 65%. Table 5 shows the results of measurement in the atmosphere at a temperature of 20° C. and a relative humidity of 30%.

TABLE 4

| Measured at 20° C. and RH of 65% | Volt of frictional electricity | |
|---|---|---|
| | Processed fabric sample | Washed fabric sample |
| Ex. 19 | 80 V | 110 V |
| Ex. 20 | 20 V | 60 V |
| Comp. Ex. 10 | 80 V | 1800 V |
| Comp. Ex. 11 | 2000 V | 1900 V |

TABLE 5

| Measured at 20° C. and RH of 30% | Volt of frictional electricity | |
|---|---|---|
| | Processed fabric sample | Washed fabric sample |
| Ex. 19 | 500 V | 900 V |
| Ex. 20 | 400 V | 800 V |
| Comp. Ex. 10 | 900 V | 8000 V |
| Comp. Ex. 11 | 3000 V | 9700 V |

EXAMPLE 21

There was prepared an aqueous solution of 8% by weight of BTC, 15% by weight of "Polyethylene Glycol #1000" and 4% by weight of sodium malate. Using the solution as a treating solution, the same procedure as in Example 10 was performed for treatments of a fabric piece made of 100% polyester, a fabric piece made of 80% polyester and 20% cotton or a fabric piece made of 50% polyester and 50% cotton, giving a processed fabric sample.

EXAMPLE 22

An aqueous solution of the same composition as in Example 21 was prepared with the exception of using 8% by weight of sodium hypophosphite and 0.6% by weight of sodium isethionate in place of sodium malate. Using the solution as a treating solution, the same procedure as in Example 21 was performed, giving a processed fabric sample.

EXAMPLE 23

An aqueous solution of the same composition as in Example 21 was prepared with the exception of using 6% by weight of monosodium phosphate and 2% by weight of lauryl dimethyl (hydroxyethyl) ammonium chloride in place of sodium malate. Using the solution as a treating solution, the same procedure as in Example 21 was performed, giving a processed fabric sample.

Comparative Example 12

An aqueous solution of the same composition as in Example 21 was prepared with the exception of not using 8% by weight of BTC. Using the solution as a treating solution, the same procedure as in Example 21 was performed, giving a processed fabric sample.

Comparative Example 13

An aqueous solution of the same composition as in Example 21 was prepared with the exception of not using 15% by weight of "Polyethylene Glycol #1000". Using the solution as a treating solution, the same procedure as in Example 21 was performed, giving a processed fabric sample.

Test Example 4

The processed fabric samples obtained above in Examples 21 to 23 and Comparative Examples 12 and 13 were washed 10 times to provide washed fabric samples, which were tested for the following.

(1) Dirt removability test

The washed samples were fouled at specified spots with lipstick, soiled motor oil and Indian ink and were left to stand for 2 hours to provide fouled fabric samples. Then the fouled fabric samples were washed once or twice to evaluate the dirt removability according to the following 5-grade rating:

1. No dirt removed
2. Dirt slightly removed
3. Dirt markedly removed
4. Only traces of dirt recognizable
5. Dirt scarcely recognizable.

The results are shown below in Tables 6 to 8.

TABLE 6

| Fabric made of 100% polyester | Lipstick | | Soiled motor oil | | Indian ink | |
|---|---|---|---|---|---|---|
| | Washed once | Washed twice | Washed once | Washed twice | Washed once | Washed twice |
| Ex. | | | | | | |
| 21 | 3 | 3 | 4 | 4 | 4 | 4 |
| 22 | 3 | 4 | 4 | 5 | 4 | 4 |
| 23 | 3 | 4 | 4 | 5 | 4 | 4 |
| Comp. Ex. | | | | | | |
| 12 | 1 | 1 | 1 | 2 | 1 | 2 |
| 13 | 1 | 1 | 1 | 2 | 1 | 2 |

TABLE 7

| Fabric made of 80% polyester and 20% cotton | Lipstick | | Soiled motor oil | | Indian ink | |
|---|---|---|---|---|---|---|
| Ex. | Washed once | Washed twice | Washed once | Washed twice | Washed once | Washed twice |
| 21 | 3 | 3 | 4 | 4 | 4 | 4 |
| 22 | 3 | 4 | 4 | 5 | 4 | 4 |
| 23 | 3 | 4 | 4 | 5 | 4 | 4 |
| Comp. Ex. | | | | | | |
| 12 | 1 | 1 | 1 | 2 | 1 | 2 |
| 13 | 1 | 1 | 1 | 2 | 1 | 2 |

TABLE 8

| Fabric made of 50% polyester and 50% cotton | Lipstick | | Soiled motor oil | | Indian ink | |
|---|---|---|---|---|---|---|
| Ex. | Washed once | Washed twice | Washed once | Washed twice | Washed once | Washed twice |
| 21 | 3 | 3 | 4 | 4 | 4 | 4 |
| 22 | 3 | 4 | 4 | 5 | 4 | 4 |
| 23 | 3 | 4 | 4 | 5 | 4 | 4 |
| Comp. Ex. | | | | | | |
| 12 | 1 | 1 | 1 | 2 | 1 | 2 |
| 13 | 1 | 1 | 1 | 2 | 1 | 2 |

(2) Antifouling property test

A solution containing 0.3 ml/liter of Indian ink and 2.5 g/liter of a household detergent was prepared and placed into a washing machine. The washed sample was washed by the machine to evaluate the antifouling property of the sample according to the 5-grade rating by JIS dirt grey scale. Grade 1 was the lowest degree of antifouling property and Grade 5 was freedom from dirt.

The results are shown below in Table 9.

TABLE 9

| | 100% polyester fabric | 80% polyester/20% cotton fabric | 50% polyester/50% cotton fabric |
|---|---|---|---|
| Ex. 21 | Grade 4–5 | Grade 4–5 | Grade 4–5 |
| Ex. 22 | Grade 4–5 | Grade 4–5 | Grade 4–5 |
| Ex. 23 | Grade 4–5 | Grade 4–5 | Grade 4–5 |
| Comp. Ex. 12 | Grade 2 | Grade 1 | Grade 1 |
| Comp. Ex. 13 | Grade 2 | Grade 1 | Grade 1 |

Test Example 5

The washed fabric samples obtained in Examples 10, 17 and 18 and Comparative Examples 7 and 8 were used as test fabric samples. Ten of each of the test fabric samples were arranged in a row and waterdrops were let fall one by one from a burette onto the test fabric samples to observe the change on the fabric surface from a mirror-like state to a moisturized state which occurred by absorption of water into the fabric. The results were evaluated according to the following 4-grade rating. The water under JIS K 0050 was used in the test.

1. The waterdrops remained long on the fabric surface.
2. On falling onto the fabric surface, the waterdrops formed a mass thereon which remained awhile and was absorbed into the fabric, leaving the surface moist.
3. On falling onto the fabric surface, the waterdrops formed a mass with a flat, mirror-like surface, which was absorbed into the fabric, leaving the surface moist.
4. On falling onto the fabric, the waterdrops were immediately absorbed into the fabric and a mirror-like surface was not observed.

The results are shown below in Table 10. There was no variation in the evaluation value among the 10 fabric samples, namely the same value was obtained by each group of test fabric samples.

TABLE 10

| | Ex. 10 | Ex. 17 | Ex. 18 | Comp. Ex. 7 | Comp. Ex. 8 |
|---|---|---|---|---|---|
| Water-absorbing capacity | 4 | 4 | 4 | 2 | 2 |

We claim:

1. Liquid ammonia-treated cellulose fibers whose partial or entire exterior is coated with an ester of (A) a polycarboxylic acid having at least three carboxyl groups and (B) a hydrophilic polyol having an oxyethylene group or groups and at least two alcoholic hydroxyl groups and/or which fibers are impregnated with said ester.

2. The cellulose fibers according to claim 1, wherein the polycarboxylic acid is at least one member selected from the group consisting of 1,2,3,4-butanetetracarboxylic acid, tricarballylic acid and citric acid.

3. The cellulose fibers according to claim 1 or 2, wherein the hydrophilic polyol is at least one member selected from the group consisting of polyethylene glycol and an adduct of ethylene oxide.

4. The cellulose fibers according to claim 3, wherein the adduct of ethylene oxide is at least one member selected from the group consisting of an ethylene oxide adduct of bisphenol A, an ethylene oxide adduct of pentaerythritol and an ethylene oxide adduct of polypropylene glycol.

5. A process for preparing liquid ammonia-treated cellulose fibers comprising the steps of treating cellulose fibers with liquid ammonia, depositing an ester of (A) a polycarboxylic acid having at least three carboxyl groups and (B) a hydrophilic polyol having an oxyethylene group or groups and at least two alcoholic hydroxyl groups on the partial or entire exterior of the liquid ammonia-treated cellulose fibers and/or impregnating said fibers with said ester, and heating said fibers.

6. A process for preparing liquid ammonia-treated cellulose fibers comprising the steps of treating cellulose fibers with liquid ammonia, depositing polycarboxylic acid having at least three carboxyl groups and hydrophilic polyol having an oxyethylene group or groups and at least two alcoholic hydroxyl groups on the partial or entire exterior of the liquid ammonia-treated cellulose fibers, and/or impregnating said fibers with said polycarboxylic acid and said hydrophilic polyol, and heating said fibers.

7. The process according to claim 5 or 6, wherein the polycarboxylic acid is at least one member selected from the group consisting of 1,2,3,4-butanetetracarboxylic acid, tricarballylic acid and citric acid.

8. The process according to claim 5 or 6, wherein the hydrophilic polyol is at least one member selected from the group consisting of polyethylene glycol and an adduct of ethylene oxide.

9. The process according to claim 8, wherein the adduct of ethylene oxide is at least one member selected from the group consisting of an ethylene oxide adduct of bisphenol A, an ethylene oxide adduct of pentaerythritol and an ethylene oxide adduct of polypropylene glycol.

10. A product of cellulose fibers produced from the cellulose fibers as defined in claim 1 or 2.

11. A product of cellulose fibers produced from the cellulose fibers prepared by the process for preparing cellulose fibers as defined in claim 5 or 6.

12. A product of cellulose fibers prepared by treating cellulose fibers with liquid ammonia, making the liquid ammonia-treated fibers into a product thereof, depositing an ester of (A) a polycarboxylic acid having at least three carboxyl groups and (B) a hydrophilic polyol having an oxyethylene group or groups and at least two alcoholic hydroxyl groups on the partial or entire exterior of the liquid ammonia-treated cellulose fibers, and/or impregnating said fibers with said ester, and heating said fibers.

13. A product of cellulose fibers prepared by treating cellulose fibers with liquid ammonia, making the liquid ammonia-treated fibers into a product thereof, depositing polycarboxylic acid having at least three carboxylic groups and hydrophilic polyol having an oxylethylene group or groups and at least two alcoholic hydroxyl groups on the partial or entire exterior of the liquid ammonia-treated cellulose fibers, and/or impregnating said fibers with said polycarboxylic acid and said hydrophilic polyol, and heating said fibers.

* * * * *

UNITED STATES PATENT AND TRADEMARK OFFICE

CERTIFICATE OF CORRECTION

PATENT NO. : 5,855,624
APPLICATION NO. : 08/817162
DATED : January 5, 1999
INVENTOR(S) : Fujitani et al.

It is certified that error appears in the above-identified patent and that said Letters Patent is hereby corrected as shown below:

On the Cover Page;
in item [73] Assignment, change "New Japan Chemical Co., Ltd., Kyoto, Japan" to be -- New Japan Chemical Co., Ltd., Kyoto, Japan; Shikibo Ltd., Osaka, Japan -- in item [87] PCT Pub No., change "WO97/67279" to be -- WO97/07279 --

Signed and Sealed this

Fifth Day of December, 2006

JON W. DUDAS
*Director of the United States Patent and Trademark Office*